US010406073B2

(12) United States Patent
Hellenbrand

(10) Patent No.: US 10,406,073 B2
(45) Date of Patent: Sep. 10, 2019

(54) TRANSPORTING DEVICE FOR AN AUTOMATED DRUG-DOSING DEVICE

(71) Applicant: CareFusion Germany 326 GmbH, Kelberg (DE)

(72) Inventor: Christoph Hellenbrand, Kaifenheim (DE)

(73) Assignee: CAREFUSION GERMANY 326 GMBH, Kelberg (DE)

( * ) Notice: Subject to any disclaimer, the term of this patent is extended or adjusted under 35 U.S.C. 154(b) by 909 days.

(21) Appl. No.: 14/900,559

(22) PCT Filed: Jun. 17, 2014

(86) PCT No.: PCT/EP2014/062654
§ 371 (c)(1),
(2) Date: Dec. 21, 2015

(87) PCT Pub. No.: WO2014/202569
PCT Pub. Date: Dec. 24, 2014

(65) Prior Publication Data

US 2016/0151244 A1 Jun. 2, 2016

(30) Foreign Application Priority Data

Jun. 20, 2013 (EP) ..... 13173073

(51) Int. Cl.
*A61J 7/00* (2006.01)
*B65B 35/40* (2006.01)
(Continued)

(52) U.S. Cl.
CPC ..... *A61J 7/0069* (2013.01); *A61J 1/16* (2013.01); *B65B 5/103* (2013.01); *B65B 35/40* (2013.01)

(58) Field of Classification Search
None
See application file for complete search history.

(56) References Cited

U.S. PATENT DOCUMENTS 2,623,647 A 12/1952 Erickson
4,101,284 A 7/1978 Difiglio
(Continued)

FOREIGN PATENT DOCUMENTS

JP 2010536426 A 12/2010
JP 2012100939 A 5/2012
WO WO-2012070643 A1 5/2012

OTHER PUBLICATIONS

Japanese Office Action for Application No. 2016-520434, dated Dec. 26, 2017, 4 pages excluding English translation.
(Continued)

*Primary Examiner* — Gene O Crawford
*Assistant Examiner* — Ayodeji T Ojofeitimi
(74) *Attorney, Agent, or Firm* — Morgan, Lewis & Bockius LLP

(57) ABSTRACT

A transporting device for an automated drug-dosing device, and in particular to a transporting device for feeding individual portions of drugs, which allows rapid cleaning of the device, is provided. The transporting device includes at least one transporting tray with a plurality of upwardly open accommodating compartments which are arranged in a single plane and are intended for accommodating one or more individual portions of drugs. The transporting device also includes a carrying frame accommodating the at least one transporting tray, wherein the at least one transporting tray is arranged in a removable manner in the carrying frame and each accommodating compartment has a base opening. The carrying frame includes a closing device with at least one closing plate, wherein base openings of the at least one transporting tray being arranged in a single plane, can be freed, and closed, by movement of the at least one closing plate relative to the at least one transporting tray.

20 Claims, 4 Drawing Sheets

(51) Int. Cl.
*B65B 5/10* (2006.01)
*A61J 1/16* (2006.01)

(56) References Cited

U.S. PATENT DOCUMENTS

| | | | | |
|---|---|---|---|---|
| 4,403,462 | A * | 9/1983 | Halbich | B65D 83/0445 53/158 |
| 4,834,264 | A | 3/1989 | Siegel | |
| 7,086,558 | B1 * | 8/2006 | Pixley | G07F 11/62 221/2 |
| 7,784,244 | B2 * | 8/2010 | Siegel | B65B 5/103 53/151 |
| 7,937,911 | B1 * | 5/2011 | McGonagle | A61J 1/035 53/158 |
| 2010/0237089 | A1 * | 9/2010 | Kodama | B65B 1/36 221/97 |
| 2013/0212987 | A1 | 8/2013 | Shigeyama et al. | |

OTHER PUBLICATIONS

International Preliminary Report on Patentability (IPRP) dated Dec. 22, 2015 in PCT/EP2014/062654 (5 pages).

* cited by examiner

TRANSPORTING DEVICE FOR AN AUTOMATED DRUG-DOSING DEVICE

CROSS-REFERENCE TO RELATED APPLICATION

This application is the U.S. National Phase under 35 U.S.C. § 371 of International Application No. PCT/EP2014/062654, filed on Jun. 17, 2014, which claims the benefit of EP13173073.1, filed on Jun. 20, 2013. The entire contents of these applications are incorporated by reference herein.

BACKGROUND OF THE INVENTION

The invention relates to a transporting device for an automated drug-dosing device, and in particular to a transporting device for feeding individual portions of drugs.

Known from the prior art is a transporting device for feeding individual portions of drugs, which device is embodied as a securely mounted drawer of an automated drug-dosing device. When in the pulled out or extended condition, a transporting device that is upwardly open and from which individual portions of drugs are transferred to the securely mounted transporting device may be placed thereupon. In addition, both the securely mounted transporting device and the mobile transporting device have a plurality of accommodating compartments for individual portions of drugs, wherein the arrangement of the accommodating compartments is complementary. The accommodating compartments of the securely mounted transporting device and the accommodating compartments of the mobile transporting device have base openings that may be opened with a closing means that is an integral component of the transporting device.

Known from the prior art is a transporting device for feeding individual portions of drugs, which device is embodied as a securely mounted drawer of an automated drug-dosing device. When in the pulled out or extended condition, a transporting device that is upwardly open and from which individual portions of drugs are transferred to the securely mounted transporting device may be placed thereupon. In addition, both the securely mounted transporting device and the mobile transporting device have a plurality of accommodating compartments for individual portions of drugs, wherein the arrangement of the accommodating compartments is complementary. The accommodating compartments of the securely mounted transporting device and the accommodating compartments of the mobile transporting device have base openings that may be opened with a closing means that is an integral component of the transporting device.

For transferring the individual portions of the drugs, a closing means includes at least one moveable closing plate, and, due to a movement of the closing plate, the base openings in the mobile or securely mounted transporting device are released so that in the case of the mobile transporting device the individual portions of drugs disposed in the accommodating compartments are transferred into the corresponding accommodating compartments of the securely mounted transporting device. From the latter, the individual portions of drugs may be transferred to another device of the automated drug-dosing device that supplies individual portions of drugs to a blister-packaging unit, for instance.

When adding individual portions of drugs to accommodating compartments or when transferring drugs from the mobile transporting device to the stationary transporting device, the drop height for the drugs means that drug particles chip off of the drugs and contaminate the closing plate, especially in the area of the edges of the base openings, and other parts of the closing means. The drug particles that have chipped off can adhere to drugs that are subsequently supplied, contaminate them, and, when the base openings are released, can be transferred either from the mobile transporting device into the stationary transporting device or from the latter to a subsequent device, ultimately traveling into the blister packaging.

It is therefore urgently necessary to thoroughly clean the accommodating compartments and the closing means regularly to remove the chipped-off drug particles. In the known transporting devices, such cleaning is extremely time consuming, since the closing plates(s) are difficult to access in areas of the base openings for the receiving compartments.

It is therefore the object of the present invention to provide a transporting device for feeding individual portions of drugs, which transporting device permits rapid cleaning of the device and in particular of the individual accommodating compartments and closing plate(s).

This object is inventively attained using a transporting device having the features of patent claim 1.

The inventive transporting device for feeding individual portions of drugs for an automated drug-dosing device comprises at least one transporting tray with a plurality of upwardly open accommodating compartments, arranged in a single plane, for accommodating one or a plurality of individual portions of drugs. The transporting tray furthermore comprises a carrying frame accommodating the at least one transporting tray.

The at least one transporting tray is arranged in a removable manner in the carrying frame and each of the plurality of accommodating compartments comprising a base opening via which the individual portions of drugs may be fed to a further device.

The transporting device or the carrying frame moreover comprises a closing means with at least one closing plate, wherein base openings of the accommodating compartments for the at least one transporting tray, said openings being arranged in a single plane, can be released and closed using a movement of the at least one closing plate relative to the at least one transporting tray, i.e. a movement of the transporting tray or of the closing plate is possible or necessary for releasing and closing.

The inventive device comprises two primary components, specifically the transporting tray, or a group of transporting trays, and the carrying frame with the closing device.

The transporting tray (hereinafter only one transporting tray will be referenced, but in accordance with the invention it is always possible to use a plurality of transporting trays) may be removed from the carrying frame, i.e. there is no permanent connection between the carrying frame and the transporting tray. Removing the transporting tray provides simple access to the closing plate(s) so that it is easy to clean it/them.

When it is removed, the transporting tray may also be cleaned rapidly, for instance using an appropriate cleaning device having a plurality of separate cleaning units that are specially adapted to engage in and clean the accommodating compartments. Alternatively, the transporting tray may be cleaned with compressed air, for example.

When appropriately adapted, the inventive transporting device for feeding individual portions of drugs may be used as a component of an automated drug-dosing device (as a "stationary" transporting device that merely transports individual portions of drugs within the drug-dosing device and is only removed for cleaning) or as a "mobile" transporting device for feeding individual portions of drugs to another transporting device that is then normally part of the automated drug-dosing device (for instance to a "stationary" version of the inventive transporting device).

The base openings that can transfer drugs are released using a relative movement between closing plate and transporting tray. Depending on the arrangement and number of accommodating compartments (and thus on the number of base openings), a special design of the closing plate or a certain number of closing plates is also necessary.

For instance, if only one row of accommodating compartments is arranged in the transporting tray, it is sufficient for the closing plate, which is then generally adapted in height to the diameter of the base opening, to be displaced parallel to the row of accommodating compartments; the openings are released depending on the height of the closing plate. If a plurality of (parallel) rows of accommodating compartments are provided, one closing plate must be moved that much farther so that all of the rows are released successively. However, when using only one closing plate, this requires a long movement path, which is difficult to manage and is complex in terms of construction. In one preferred embodiment of the transporting device, the at least one closing plate therefore comprises a plurality of recesses that are adapted to the number and geometry of the base openings in the transporting tray. Alternatively, one continuous base opening per row may also be present.

Alternatively, the closing plate may also swing open "in the downward direction," wherein this may require a taller embodiment for the transporting device and probably is most reasonable to use with the stationary version of the inventive transporting device.

The base openings of the accommodating compartments should only be opened if feeding of individual doses of drugs is to be conducted, that is, normally the base openings should be closed so that, for instance, if the mobile transporting device is brought from a filling site to a transfer site, individual portions cannot fall out without a user noticing. In one preferred embodiment of the transporting device, therefore, the latter comprises a restoring means with which the at least one closing plate may be moved into a transport position and retained there. Due to the restoring force of the restoring means, the at least one closing plate is moved out of the transfer position (in which the base openings of the accommodating compartments are released) into the transport position as soon as no more force holding the closing plate in the transfer position is being applied. In the transport position, the closing plate is held in this position without external force being applied. The restoring means may be, for instance, a compression spring that exerts a restoring force urging the at least one closing plate into the transport position when there is a movement of the at least one closing plate out of the transport position.

A corresponding embodiment of the transporting device is indicated when the closing plate is moved for releasing the base openings of the accommodating compartments. However, if the transporting tray in the carrying frame is moved for releasing the base openings, the restoring means may be such that the transporting tray may be moved into a transport position and retained in this position.

To simplify a transfer of individual portions of drugs from one mobile transporting device to another mobile transporting device (for instance as a component of the drug-dosing device), in one preferred embodiment the transporting device comprises a handle with which the at least one transporting tray or the at least one closing plate may be moved from a transport position to a drug-transfer position. If only one closing plate is present (that can release all of the base openings), all individual portions of drugs may be transferred to the device disposed therebelow with one movement of the handle. A corresponding embodiment of the transporting device is especially useful in the mobile version, since all of the drugs can be transferred so simply and rapidly.

To further simplify cleaning of the closing plate(s), in one preferred embodiment they may be detachably attached (as part of the closing device) to the transporting device. Although it is not necessary to remove the closing plate for each cleaning, thorough cleaning/disinfecting of the closing plates is recommended at regular intervals and can be performed quickly with detachably arranged closing plates.

The closing device for the transporting device comprises at least one closing plate; as stated in the foregoing, this makes sense especially with the "mobile" transporting device.

In a stationary transporting device, however, generally a transfer of all drugs in one step is not desired. The drugs are normally transferred to intermediate buffers that are arranged under the transporting device and via which the drugs are supplied to a blister-packaging unit. Normally an intermediate buffer comprises a plurality of sub-units arranged in a row, and for reasons of cost, as a rule one drug-dosing device includes only one intermediate buffer. In one preferred embodiment of the inventive transporting device, the upwardly open accommodating compartments are arranged in a plurality of rows and at least one closing plate of the closing device is allocated to each row of accommodating compartments. The plurality of closing plates are preferably individually movable so that each row of accommodating compartments may be released separately. For transferring individual portions of drugs, the transporting device is to this end moved in the drug-dosing device such that all of the rows in the intermediate buffer can be transferred successively. If a plurality of rows are provided for rapid blister packaging, the transporting device may also be moved in two steps. In this case, it may also be sufficient for the closing plates to be released in pairs. In this embodiment, as well, the closing plates may alternatively "swing open" in the downward direction.

With such a symmetrical structure or a symmetrical arrangement of the accommodating compartments, it is also necessary that the closing plates do not exceed a certain maximum width, if they are all borne in one plane and are moved therein, (in this embodiment of the closing plates, width relates to the side parallel to the shorter end faces of the transporting device) so that sufficient distance remains therebetween for the release movement (at least the diameter of the base openings). Alternatively, when the base openings are released a closing plate may move out of the plane and, for instance, slide onto the adjacent closing plate or swing downward.

If especially many rows of accommodating compartments are desired in the transporting tray, in one preferred embodiment of the invention it is provided that allocated to each row of accommodating compartments are two parallel closing plates that during the release of the base openings of the accommodating compartments are moved, for instance, under or over an adjacent closing plate. In this manner the width of the closing plates must merely equal about half the diameter of the base openings, so that the rows of accommodating compartments may be disposed closer to one another, which means that significantly more individual portions may be fed with one transporting tray.

The width of the closing plates generally only slightly exceeds the diameter of the base openings in order to provide complete closing of the base openings, while on the other hand not wasting too much material for the closing plates.

To simplify installation/de-installation of the transporting device into and out of the drug-dosing device and to permit a movement therein, in one preferred embodiment of the transporting device the latter comprises guide means via which the transporting device may be placed or inserted into the automated drug-dosing device and moved therein.

The invention shall be described in greater detail in the following, referencing the attached drawings.

The first embodiment of the inventive transporting device 1, illustrated in FIG. 1A-1D, comprises a carrying frame 12 that is embodied in one piece in the illustrated embodiment. A transporting tray 10 is removably placed into the carrier frame 12, i.e. there is no permanent attachment between the transporting tray 10 and the carrying frame 12, the tray merely lies in the carrying frame.

Figure 1A:
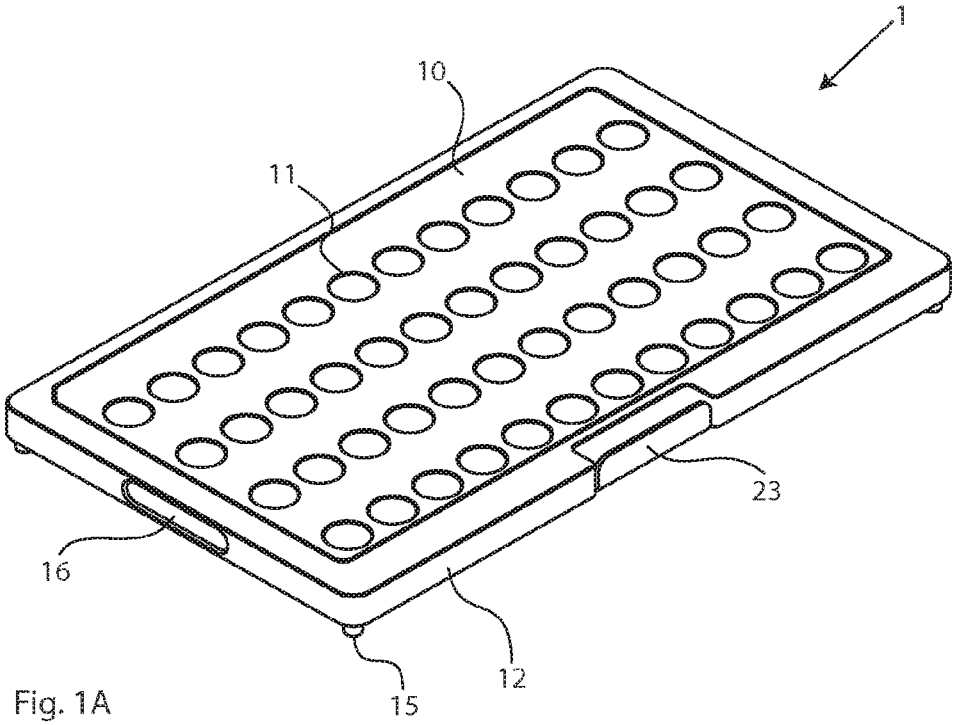
FIG. 1A is an isometric projection of a first embodiment of the inventive transporting device.
Figure 1B:
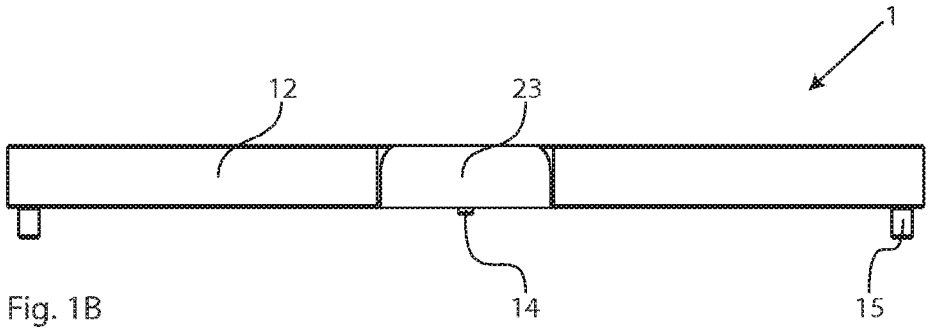
FIG. 1B is a front view of the first embodiment.
Figure 1C:
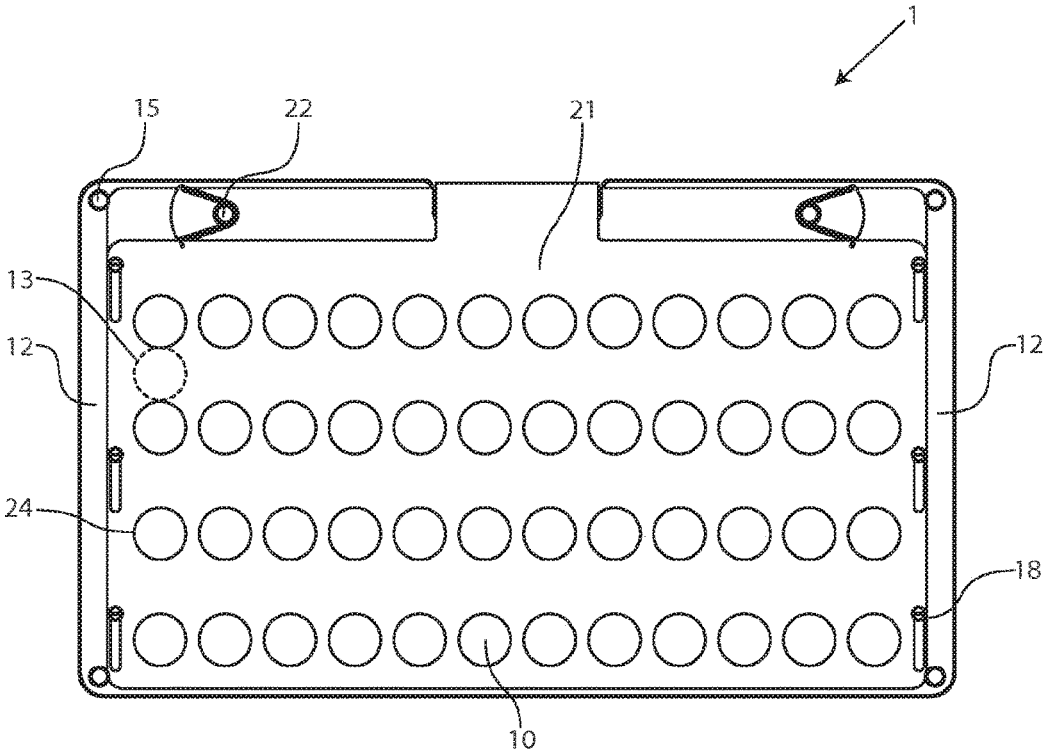
FIG. 1C is a bottom view of the first embodiment in the transport position.

The transporting tray 10 comprises a plurality of upwardly open accommodating compartments 11 that are arranged in one plane and that extend through the transporting tray and have a base opening 13 (not visible in FIG. 1A and suggested in FIG. 1C). An accommodating compartment 11 may be embodied in a cylinder or cone shape, wherein the surfaces of the walls delimiting the accommodating compartments are preferably embodied such that no particles can adhere thereto.

Only one transporting tray 10 is arranged in the carrying frame 12 in the illustrated embodiment. In other embodiments, two or more transporting trays may be arranged in the carrying frame 12, for instance having accommodating compartments with different diameters, to adapt the transporting device to drugs of different sizes.

A gripping means 16 in the form of a depression is arranged on the end faces of the carrying frame 12, wherein only one of these gripping means may be seen in FIG. 1A due to the isometric projection.

In one longitudinal side of the carrying frame 12 a handle 23 may be seen with which a closing plate 21 (see FIGS. 1C and 1D) of a closing device 20 of the transporting device 1 may be moved relative to the transporting tray 10 and the base openings 13 of the accommodating compartments 11.

The transporting device 1 furthermore includes in each of the corners of the carrying frame 12 a positioning means 15 with which the transporting device may be arranged for transferring the drugs onto or to another device that receives the drugs.

Figure 1D:
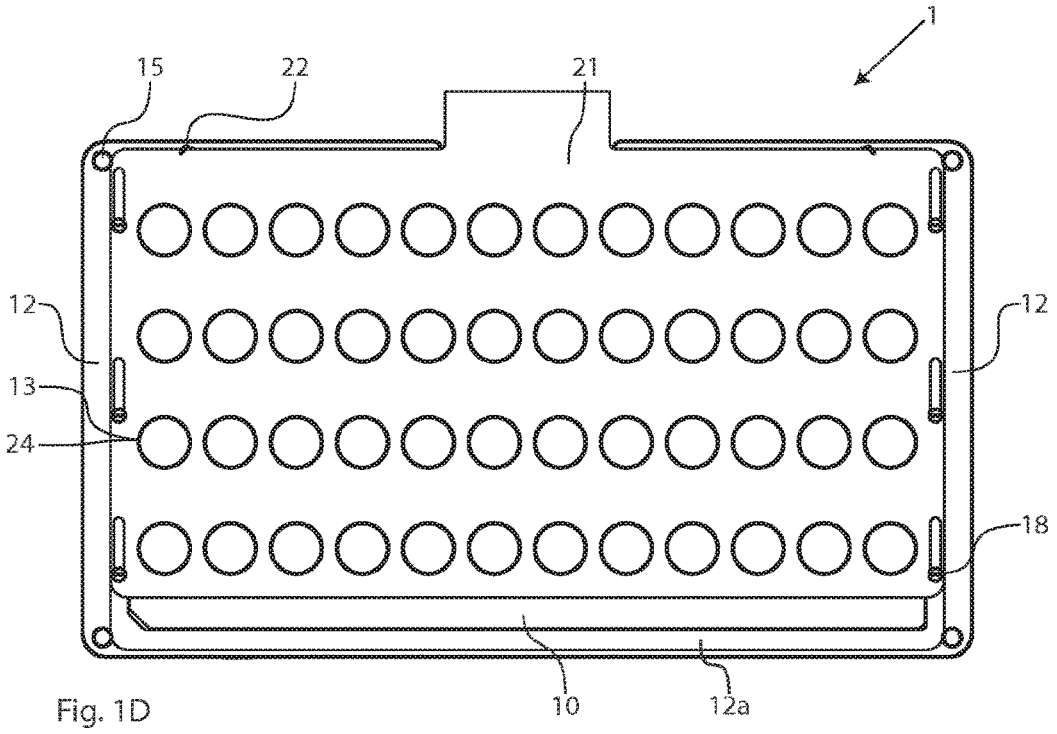
FIG. 1D is a bottom view of the first embodiment in the transfer position.

FIGS. 1C and 1D provides views of the first embodiment from below, wherein FIG. 1C illustrates a transport position for the transporting device and FIG. 1D illustrates a transfer position for the transporting device 1.

The closing plate 21 (visible in FIGS. 1C and 1D) of the closing device 20 is attached to the carrying frame with a plurality of retaining means 18. In the illustrated embodiment, in addition to the closing plate 21 and the handle 23, the closing device 20 furthermore comprises restoring means 22 that are supported on the carrying frame 12 and the closing plate 21, as may be seen especially in FIG. 1C.

The closing plate 21 is disposed in the transport position in the position shown in FIG. 1C. The closing plate comprises a plurality of recesses 24, the diameter of which are adapted to the diameter of the base openings 13 of the accommodating compartments 11, wherein in the illustrated embodiment the diameter of the base openings 13 and of the recesses 24 are essentially identical. In the transport position, illustrated in FIG. 1C, with its areas between the rows of recesses 24 the closing plate 21 covers the base openings 13 of the accommodating compartments 11, wherein a base opening 13 is indicated using a dashed line.

When the handle 23 is used to move the cover plate 21 from the transport position illustrated in FIG. 1C to the transfer position illustrated in FIG. 1D (in the type of illustration selected for FIGS. 1C and 1D, an "upward" movement of the closing plate), a restoring force is built up (or increased) in the restoring means 22 embodied as a spring element and the recesses 24 of the closing plate are moved flush with the base openings 13 or the accommodating compartments or aligned with them. As soon as the recess 24/base opening 13 transition is sufficiently large for the individual portions of drugs that are arranged in the accommodating compartments, gravity causes the drugs to be transferred to another device arranged below the transporting device.

The embodiment of the inventive transporting device illustrated in FIGS. 1A-1D is a mobile version of this transporting device. In a filling workstation, the transporting device may be filled by a user of the filling workstation with precisely pre-specified individual portions of drugs for the specific accommodating compartments, and may be transported by the user from the filling workstation to an automated drug-dosing device. There the mobile version of the transporting device may be placed, using positioning means 15, on a stationary form of the inventive transporting device for transferring the individual portions of drugs. The stationary version of the inventive transporting device shall be described in the following.

FIGS. 2A-2E illustrate different views of a second embodiment of the inventive transporting device, wherein this second embodiment is the stationary version of the transporting device. In the context of this specification, "stationary" shall be construed to mean that although the transporting device is movable within the drug-dosing device (and thus individual portions of drugs are transported within this device), it is not embodied specially for the transport and transfer purposes of the mobile transporting device. For instance, it is not provided that the stationary transporting device (apart from possibly special cleaning purposes will be removed from the drug-dosing device. The closing plate(s) may be cleaned the transporting device is pulled far enough out of the drug-dosing device that the transporting tray may be removed from the carrying frame.

As with the first embodiment, the embodiment illustrated in FIGS. 2A-2D comprises a carrying frame 12 that in this embodiment is embodied in four parts, having two end-face elements and two longitudinal elements. Arranged in the carrying frame 12 is a transporting tray 10 having a plurality of accommodating compartments 11 arranged in rows and columns, wherein the transporting tray 10 is supported via a bar 10*a* on a corresponding support surface 12*b* of the carrying frame 12. In the transporting device, the end-face elements of the carrying frame include positioning means 15*b* with which, for instance, the mobile version of the transporting device may be positioned on the stationary version of the transporting device.

Furthermore arranged in the two end-face elements of the *transporting frame 12 are gripping means 16** that are embodied as recessed handles in this embodiment.

Figure 2A:
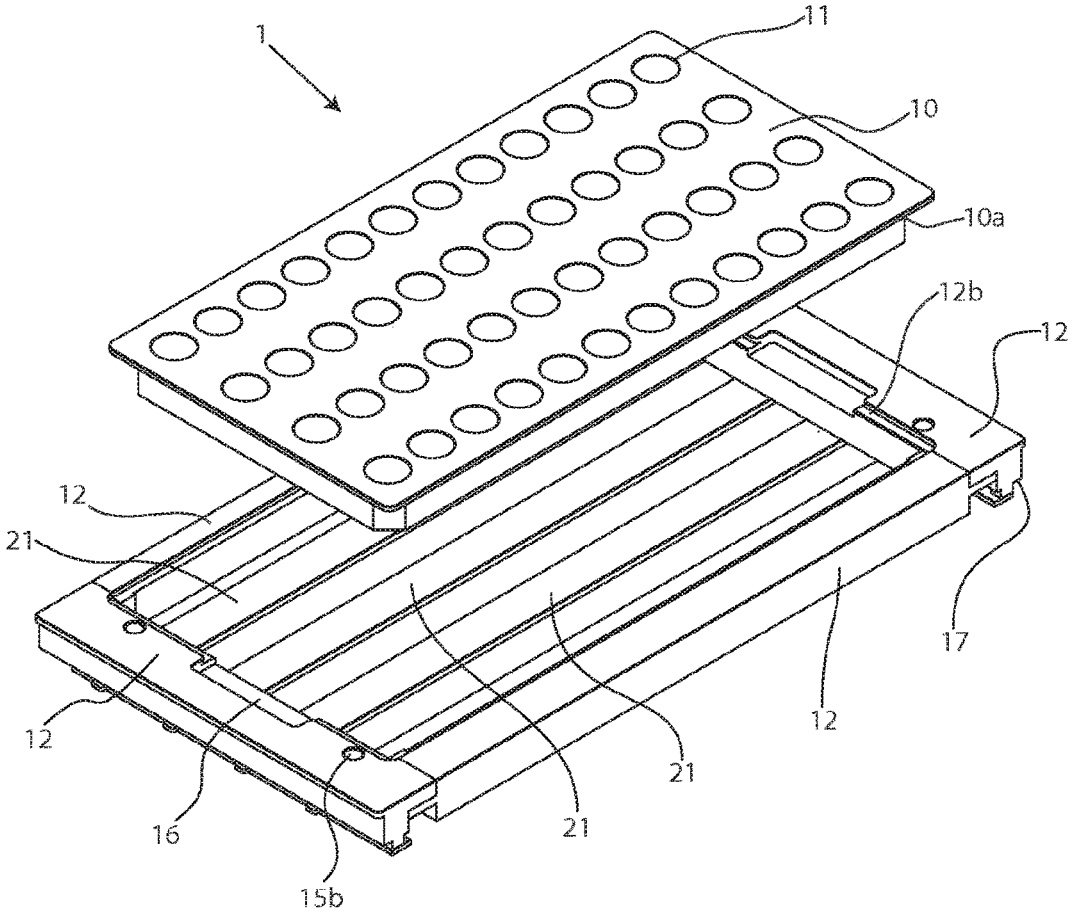
FIG. 2A is an exploded isometric projection of a second embodiment.
Figure 2B:
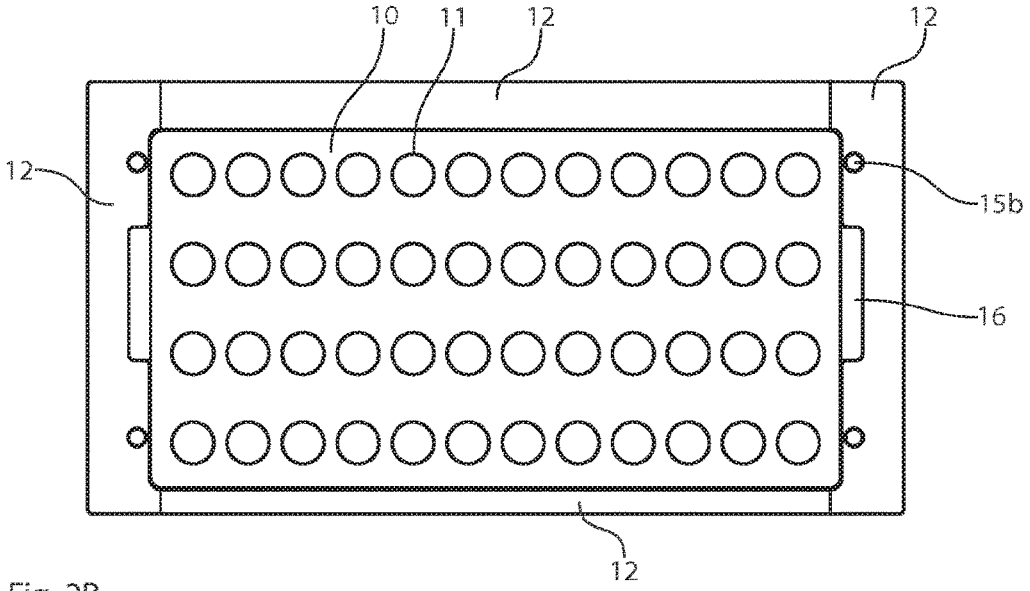
FIG. 2B is a top view of the second embodiment.

As may be seen in FIG. 2A, this embodiment of the inventive transporting device 1 does not include an individual closing plate 21, but rather includes a plurality of closing plates 21 that are arranged at a distance from and parallel to one another. The transporting device in accordance with the second embodiment furthermore includes on the end-face elements of the carrying frame 12 guide means 17 via which the transporting device may be placed into an automated drug-dosing device and is moveable therein.

Figure 2C:
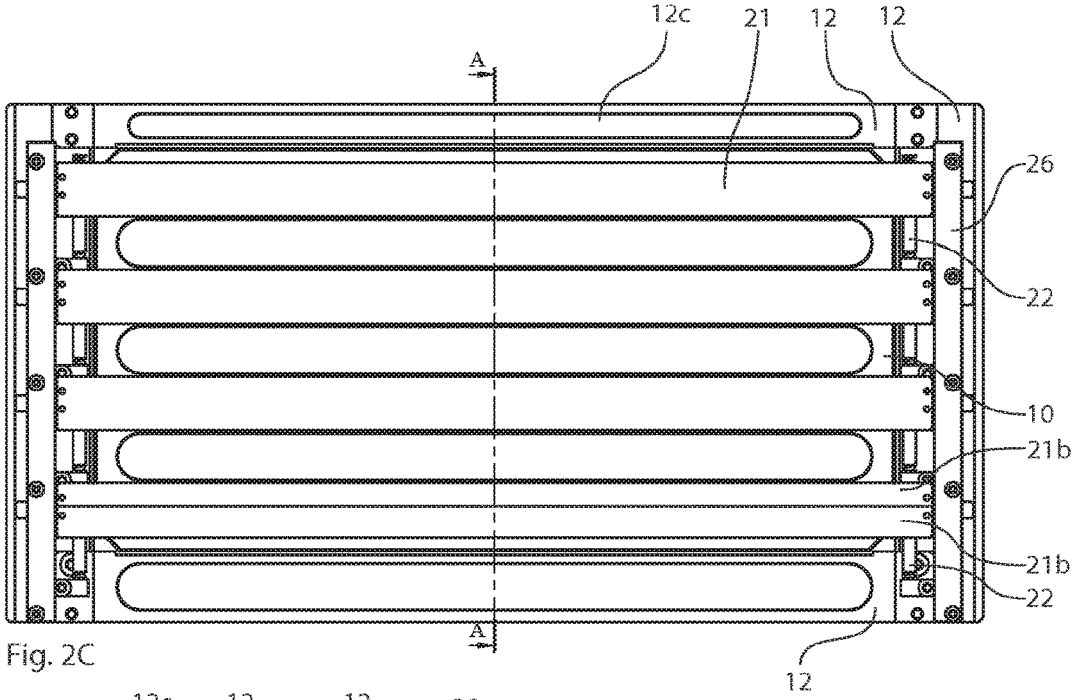
FIG. 2C is a bottom view of the second embodiment.
Figure 2D:
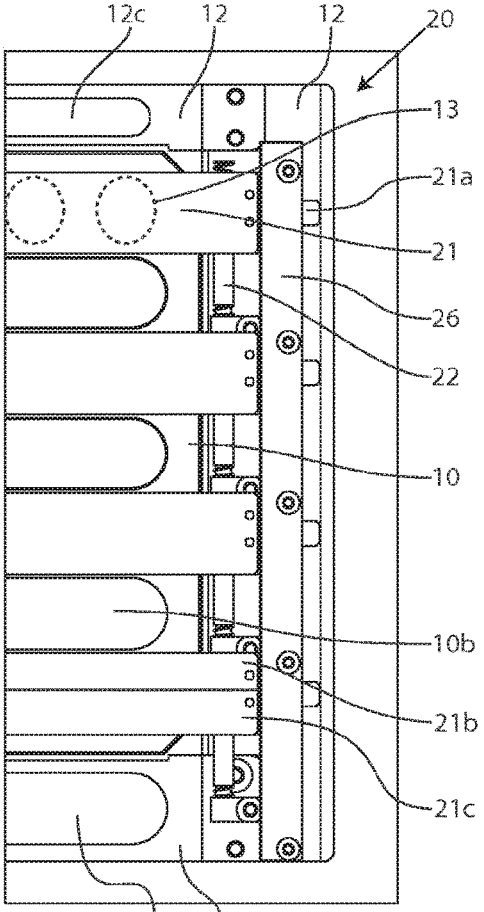
FIG. 2D illustrates a detail of the closing device in the second embodiment; and, FIG. 2E is a side view in accordance with the section line A-A shown in FIG. 2C.

FIG. 2C illustrates a bottom view of the second embodiment and FIG. 2D illustrates a detail from an end-face area of the transporting device. Attached in the end-face elements of the carrying frame 12 is a closing plate guide 26 in which are guided the total of four closing plates 21 used in this embodiment. The end of each closing plate 21 has a closing plate projection 21*a* that projects from the closing plate guide 26 and via which the closing plates 21 may be moved individually against restoring means 22, wherein during such a movement of a closing plate 21 base openings 13 of the transporting tray 10 that are arranged in a row are released.

FIGS. 2C and 2D illustrate the transport position in which, for instance, the transporting device is moved by row in the automated drug-dosing device. In the embodiment illustrated, the restoring means 22 are embodied as springs that, at least during the movement of a closing plate 21 from the transport position to the transfer position builds up a restoring force that moves the closing plate 21 back into the transport position as soon as no more force is being exerted via the closing plate projections 21.

In the illustrated embodiment, the closing plates 21 are moved via a motor (not shown) arranged outside of the transporting device 1. In other embodiments of the transporting device, however, it is also possible for a motor for moving the closing plates to be part of the closing device 20 of the transporting device 1.

Figure 2E:
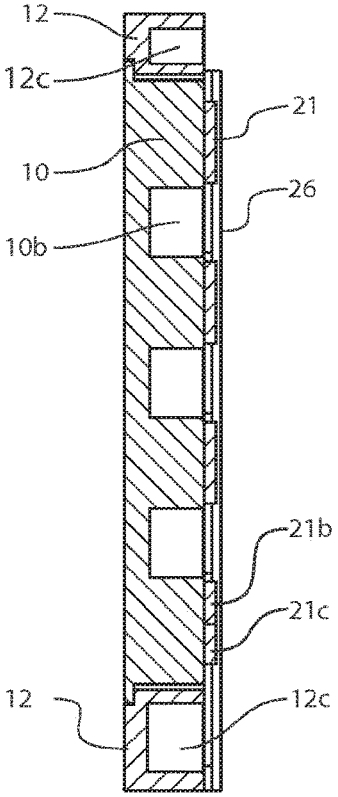

As may be seen especially in FIGS. 2D and 2E, the bottoms of the longitudinal elements of the carrying frame 12 and the transporting tray 10 (that is seen from below in FIG. 2D and in section in FIG. 2E) have cut-outs 12*c* and 10*b* that are added to save material.

The materials to be used in the inventive transporting device should be selected such that as few impurities as possible can remain adhering thereto and all hygiene regulations that must be followed, for instance in hospitals, are satisfied. Moreover, the materials should be selected according to current demands.

In each of the lower sections of FIGS. 2C-2E, another embodiment is suggested in which allocated to a row of accommodating compartments 11 (not visible) are two closing plates 21*b*, 21*c* that may move apart from one another for releasing the base openings of the row of accommodating compartments, i.e., one may move "upward" and one may move "downward." If two closing plates are allocated to a plurality of adjacent rows of accommodating compartments and the rows are arranged very close to one another (approximately half the diameter of the base openings), during release the closing plates slide under or over adjacent closing plates. Alternatively, the closing plates are swung outward out of the plane for release.

In accordance with the invention, numerous variations of the two illustrated embodiments are possible. As suggested in the foregoing, it is possible, for instance, to use not just one transporting tray, but instead a plurality of transporting trays having for instance differently dimensioned accommodating compartments, wherein in this case care must always be taken that either the recesses in the one closing plate used or the dimensioning and spacing of the closing plates is adapted to the geometry of the base openings of the accommodating compartments.

In the illustrated second embodiment, the closing plates are oriented parallel to the longitudinal elements of the carrying frame, wherein it is also possible to orient them parallel to the end-face elements of the carrying frame, wherein the embodiment that is preferable is a function of the design of the automated drug-dosing device.

What is claimed is:

1. A transporting device for feeding individual portions of drugs to an automated drug-dosing device, the transport device comprising:

at least one transporting tray with a plurality of upwardly open accommodating compartments arranged in a single plane and configured to accommodate one or more individual portions of drugs; and a carrying frame accommodating the at least one transporting tray and comprising a closing device having at least one closing plate, wherein the at least one transporting tray is removably arranged in the carrying frame, wherein each accommodating compartment has a base opening, and, wherein the base openings are configured to be released and closed using a movement of the at least one closing plate relative to the at least one transporting tray.

2. The transporting device of claim 1, wherein the at least one closing plate has a plurality of recesses.

3. The transporting device of claim 1, further comprising a handle with which the at least one transporting tray is configured to be moveable from a transport position to a transfer position.

4. The transporting device of claim 1, wherein the at least one closing plate is detachably arranged.

5. The transporting device of claim 1, further comprising a motor coupled to the at least one closing plate, the motor configured to move the at least one closing plate.

6. The transporting device of claim 1, wherein the base openings are arranged in one plane.

7. The transporting device of claim 1, further comprising a handle with which the at least one closing plate is configured to be movable from a transport position to a transfer position.

8. The transporting device of claim 1, further comprising a restoring device with which the at least one closing plate is configured to be moved into a transport position and retained there.

9. The transporting device of claim 8, wherein the restoring device is a compression spring.

10. The transporting device of claim 1, wherein the upwardly open accommodating compartments are arranged in a plurality of rows.

11. The transporting device of claim 10, wherein at least one closing plate is arranged with each row of accommodating compartments.

12. The transporting device of claim 11, wherein each closing plate is individually movable.

13. The transporting device of claim 1, wherein the carrying frame of the transporting device comprises a guide member.

14. The transporting device of claim 13, wherein the guide member is configured to guide insertion of the transporting device into the automated drug-dosing device.

15. The transporting device of claim 13, wherein the guide member is configured to guide movement of the transporting device within the automated drug-dosing device.

16. A transporting device for feeding individual portions of drugs to an automated drug-dosing device, the transport device comprising:

a plurality of transporting trays, each transporting tray having upwardly open compartments configured to hold one or more drug portions, each compartment having a base opening;

a carrying frame configured to removably receive the plurality of transporting trays within the carrying frame; and a closing device having a plurality of movable closing plates, wherein each movable closing plate is configured to block one or more base openings when in a first position, and to unblock the one or more base openings when in a second position.

17. The transporting device of claim 16, wherein the compartments of a first transporting tray are sized differently than the compartments of a second transporting tray.

18. The transporting device of claim 16, wherein the plurality of movable closing plates are disposed parallel to longitudinal elements of the carrying frame.

19. The transporting device of claim 16, wherein the plurality of movable closing plates are disposed parallel to end-face elements of the carrying frame.

20. A transporting device for feeding individual portions of drugs to an automated drug-dosing device, the transport device comprising:

a plurality of transporting trays, each transporting tray having open compartments configured to hold one or more drug portions, each compartment having opposing base and top openings;

a carrying frame configured to removably receive the plurality of transporting trays within the carrying frame; and at least one movable closing plate, wherein the at least one movable closing plate is configured to move between first and second positions, the first position configured to block the base openings of at least one transporting tray so that the compartments hold one or more drug portions, and the second position configured to unblock at least a portion of the base openings so that the one or more drug portions pass through the base openings.

* * * * *